US006478612B2

(12) United States Patent
Okano

(10) Patent No.: US 6,478,612 B2
(45) Date of Patent: Nov. 12, 2002

(54) CONNECTOR FOR A FLAT CABLE

(75) Inventor: Kazuya Okano, Kanagawa (JP)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/739,435

(22) Filed: Dec. 18, 2000

(65) Prior Publication Data

US 2001/0027057 A1 Oct. 4, 2001

(30) Foreign Application Priority Data

Dec. 17, 1999 (JP) ..... 11-359846

(51) Int. Cl.[7] ..... H01R 9/07
(52) U.S. Cl. ..... 439/495; 439/67
(58) Field of Search ..... 439/492, 493, 439/495, 329, 331, 494, 66, 67

(56) References Cited

U.S. PATENT DOCUMENTS

| | | | | |
|---|---|---|---|---|
| 3,989,336 A | | 11/1976 | Rizzio, Jr. et al. | |
| 4,252,393 A | | 2/1981 | Johnson | |
| 4,265,507 A | | 5/1981 | Johnson | |
| 4,563,050 A | * | 1/1986 | Greenwood et al. | 439/495 |
| 4,639,063 A | * | 1/1987 | Mueller | 439/495 |
| 4,718,859 A | | 1/1988 | Gardner | 439/329 |
| 4,778,403 A | | 10/1988 | Ikesugi et al. | 439/329 |
| 5,240,430 A | | 8/1993 | Soes | 439/260 |
| 5,385,478 A | * | 1/1995 | Niekawa | 439/67 |
| 5,542,855 A | | 8/1996 | Asai | 439/260 |
| 5,741,154 A | | 4/1998 | Fujikura et al. | 439/495 |
| 5,842,883 A | | 12/1998 | Igarashi et al. | 439/495 |
| 5,895,287 A | | 4/1999 | Seto et al. | 439/495 |
| 5,993,247 A | * | 11/1999 | Kidd | 439/495 |
| 6,022,242 A | * | 2/2000 | Suzuki | 439/495 |
| 6,030,246 A | * | 2/2000 | Kunishi | 439/329 |

* cited by examiner

*Primary Examiner*—Hien Vu
(74) *Attorney, Agent, or Firm*—Woodcock Washburn LLP

(57) ABSTRACT

A first group comprising a plurality of terminals 2*a* arranged to align the distal ends and a second group comprising a plurality of terminals similarly arranged to align the distal ends such that the distal ends of each of the terminals 2*b* of the second group are disposed so as to alternate with the distal ends of each terminal 2*a* of the first group and to have their proximal ends anchored in a housing 3, and in this housing 3 an insertion hole 8 is formed in which the end of a flat cable C abuts the distal ends of each terminal 2*a* and 2*b* of the first group and second group, a plate 4 is interposed between the end of the flat cable C inserted into the insertion hole 8 and the terminals 2*a* and 2*b* of the first group and second group, and furthermore, in the housing 3 a long hole 11 is formed so that by displacing the plate 4, each terminal 2*a* and 2*b* of the first and second groups is flexibly deformed to separate from the flat cable C.

5 Claims, 2 Drawing Sheets

CONNECTOR FOR A FLAT CABLE

BACKGROUND OF THE INVENTION

1. Field of the Invention

The present invention relates to a connector for a flat cable used for connecting a flat cable to a printed board.

2. Description of Related Art

When simultaneous transmission of many signals is necessary in an electrical device such as an personal computer, frequently a flat flexible cable, or flat cable, having a plurality of metal wires disposed in parallel is used.

A connector used for connecting this type of cable to a printed board, for example, the connector disclosed in Japanese Unexamined Utility Model, First Publication, No. Hei 4- 61883, is formed by a housing that provides a plurality of terminals arranged inside in parallel at a specified pitch, and a pressing/loading member provided to open and close a release part provided on the side surface of the housing that presses the flat cable onto the contact point of each terminal.

In this connector, the distal ends of a plurality of terminals that are to serve as the contact points are arranged facing in the same direction, the flat cable is inserted from the direction relative to the terminals whose distal ends serve as the contact points, and anchored by being pressed against the housing by the pressing member.

Recently, accompanying the increasingly high capacity of electronic devices, the need to transmit more signals simultaneously and in parallel is increasing, and flat cables having even more metal wires than the flat cable connected to the above-described connector are being developed.

To make these flat cables practical to use, the development of connectors used for connecting them to a printed board is indispensable. However, because the gap between each metal wire of the flat cable is becoming narrower than conventionally, when attempting to use the structure of the above conventional connector as-is, the gap between each of the terminals is becoming accordingly narrower, and the connections of the terminals to the printed board become extremely narrow and complicated.

In consideration of the above-described problems, it is an object of the present invention to provide a connector for a flat cable that can connect a flat cable having even more metal wires than conventionally, and making the connection to the printed board easy to carry out.

SUMMARY OF THE INVENTION

A flat cable connector according to the present invention is characterized in: a first group comprising a plurality of terminals having distal ends serving as connection points with a flat cable arranged facing one direction and a second group comprising a plurality of terminals having distal ends serving as connection points with the flat cable arranged facing the other direction and reciprocating each of the terminals of the first group being anchored in a housing at the proximal end of terminal in a state wherein the distal end of each terminal of the second group and the distal end of each terminal of the first group are disposed so as to alternate with each other; an insertion opening being formed in the housing, into which the end part of the flat cable enters and then abuts the distal end of each terminal of the first and the second groups; a plate being interposed in the space between the end part of the flat cable inserted into the insertion opening and each terminal of the first and second groups; and a plate displacing mechanism being provided that, by displacing the plate, elastically deforms and thereby separates from the flat cable each of the terminals of the first and second groups.

In this connector for a flat cable, the connection of a flat cable having even more metal wires than conventionally can be connected because even if the gap between each terminal is narrow, the connection to the board does not become complicated due to a structure wherein each terminal of the first group face each terminal of the second group and at the same time the distal ends of the terminals that serve as the connection points with the flat cable are disposed so as to alternate with each other.

In addition, when connecting the flat cable, each terminal of the first and second groups is flexibly deformed by displacing a plate, and thus when the end part of the flat cable is inserted into the insertion opening, the end of the flat cable is not hindered by any terminal of the second group, and reaches a specified position within the housing. Subsequently, when the flexible deformation of each of the terminals of the first and second groups is relieved, the distal end of each terminal can communicates by abutment with the end of the flat cable.

When removing the flat cable, each of the terminals of the first and second groups is flexibly deformed by displacing the plate in the same manner and separated from the end of the flat cable, and then the flat cable is pulled out. Thus, as when connecting, the end of the flat cable can be extracted from the insertion opening without interference from each terminal of the second group.

In the plate displacement mechanism, a structure preferably used comprises an overhang of the plate that overhangs in the more outward traverse direction of the flat cable than the flat cable inserted from the insertion hole and an opening communicating with this overhang by being formed in the direction of displacement of the plate on the housing. Thereby, there is no influence from the flat cable, and the plate can be easily operated.

PREFERRED EMBODIMENT OF THE PRESENT INVENTION

An embodiment of the connector for a flat cable according to the present invention is explained referring to the figures.

Figure 1:
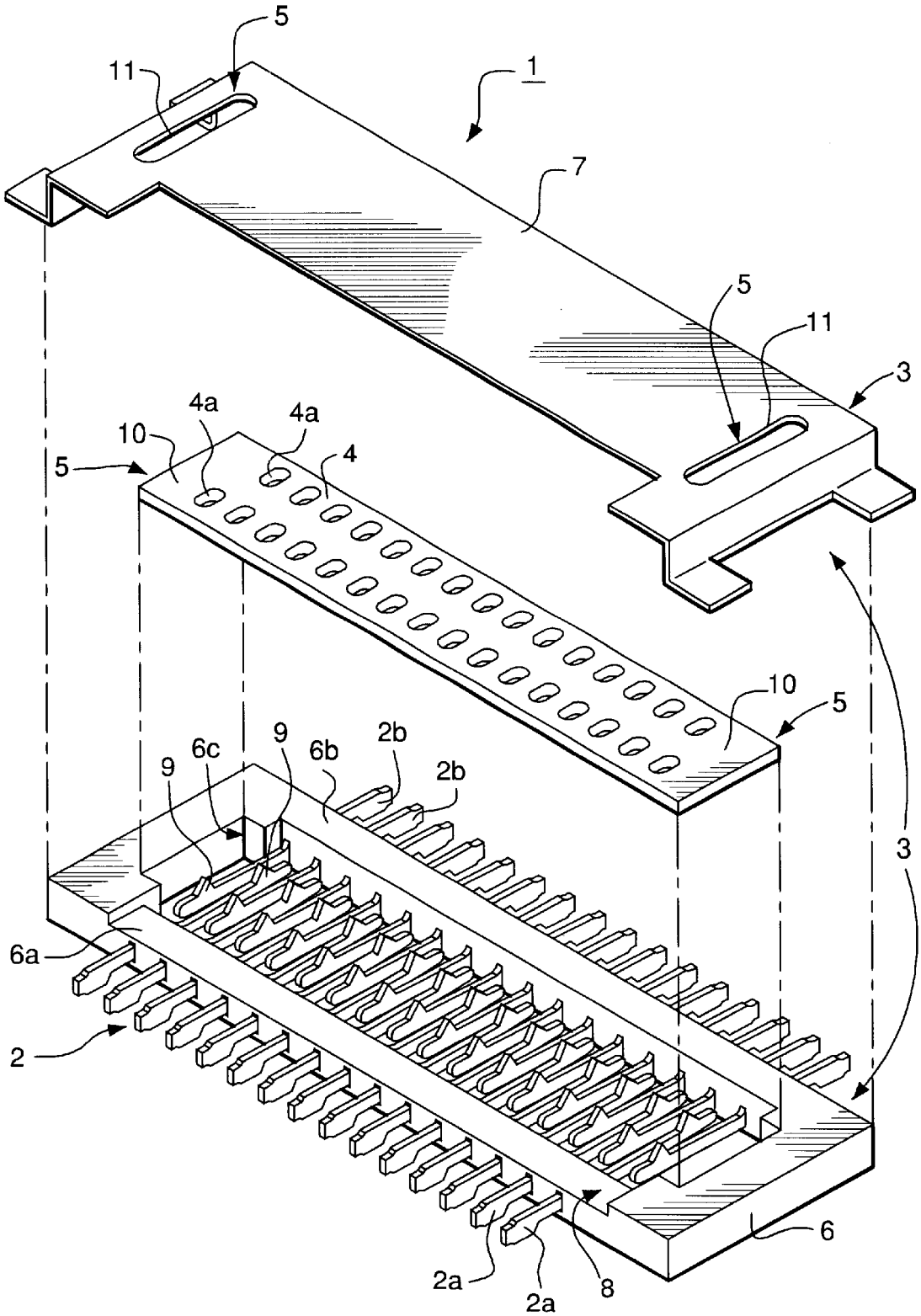
FIG. 1 is an exploded perspective view showing the structure of the connector for a flat cable according to the present invention.
Figure 2:
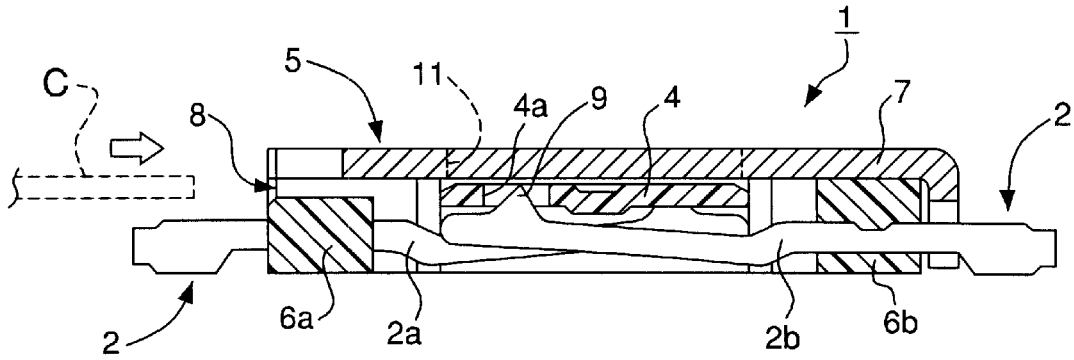
FIG. 2 is a side cross-sectional drawing showing the structure of a connector for a flat cable according to the preset invention.

The connector for a flat cable 1 (below, referred to simply as a "connector") shown in FIG. 1 and FIG. 2 provides a plurality of metal terminals 2, a housing 3 that anchors this plurality of terminals 2, a plate 4 interposed between the distal ends of the flat cable C (not shown in FIG. 1) inserted into the housing 3 and each terminal 2, and a plate displacement mechanism 5 that separates each terminal 2 from the flat cable C by displacing the plate 4.

The plurality of terminals 2 is divided into a first group comprising a plurality of terminals 2*a* arranged by facing the distal ends that serve as contacts with the flat cable C in one direction and a second group comprising a plurality of terminals 2*b* that are arranged by facing the distal ends that serve as contacts with the same flat cable C in the other reciprocating direction. This plurality of terminals 2 is arranged so that the distal ends of each terminal 2*b* of the second group are disposed so as to alternate with the distal ends of each terminal 2*a* of the first group, and furthermore, the proximal ends of all these terminals 2*a* and 2*b* are anchored in the housing 3.

The housing 3 comprises a synthetic resin lower frame 6 and a metal upper frame 7 attached to the lower frame 6. A plan view shows the lower frame 6 to be a rectangular frame, and the proximal ends of each terminal 2*a* in the first group are anchored on one of the long sides 6*a* and the proximal ends of each terminal 2*b* of the second group are anchored on the other long side 6*b*. The distal end of each terminal 2*a* and 2*b* of the first and second groups are disposed in parallel so as to alternate with each other on the long side 6*a* (or 6*b*) in the space 6*c* inside the lower frame 6.

When seen from a plan view, the upper frame 7 is a rectangular plate approximately equal in external dimensions to the lower frame 6, and is attached to the lower frame 6 so as hide the space 6*a* and cover the distal end of each terminal 2*a* and 2*b* of the first and second groups.

A section of one of the long edges 6*a* of the lower frame 6 is cut away along the width on which are disposed each of the terminals 2*a* of the first group, and a gap is formed between the lower frame 6 the upper frame 7. This gap forms an insertion opening 8 into which the end of the flat cable C enters and then abuts the ends of the terminals 2*a* and 2*b* of the first and second groups.

The plate 4 is made of a synthetic resin and is rectangular. The plate 4 is mounted on each of the terminals 2*a* and 2*b* of the first and second groups, and fit into the space 6*c* inside the lower frame 6 so as to play therein. Here, on each terminal 2*a* and 2*b* of the first and second groups, a projection 9 projecting towards the upper frame 7 is formed, and actually, this projection 9 abuts the end of the flat cable C inserted into the insertion hole 8 to create a conductive state, and in the plate 4, a plurality of small holes 4*a* in which the projections 9 engage with allowance for play are formed conforming to the projections 9 of each terminal 2*a* and 2*b*.

The plate displacing mechanism 5 comprises the overhang 10 on both distal ends of the plate 4, extending more in the outward traverse direction than the flat cable C inserted in the insertion hole 8, and long hole (opening) 11 formed on the upper plate 7 and communicating with the overhang 10 of the plate 4. The plate 4 is supported from below on each terminal 2*a* and 2*b* and disposed at a position that leaves almost no gap between it and the upper plate 7, and is deformable by pressing down on the overhang 10 via the long hole 11.

Figure 3A:
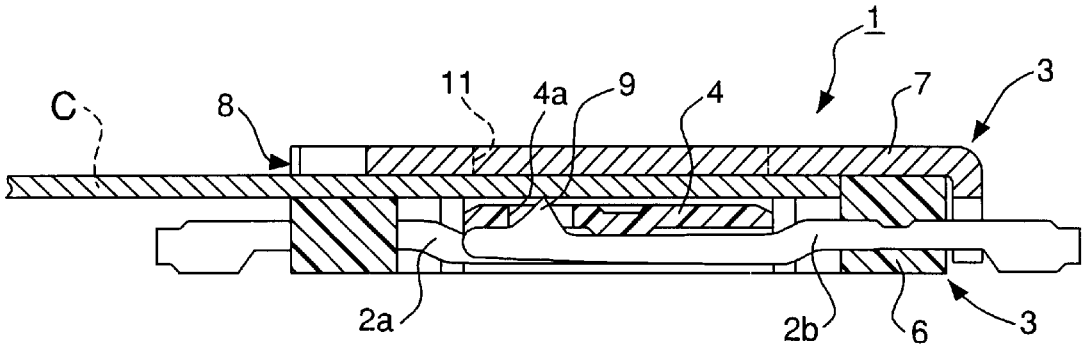
FIG. 3 is a cross-sectional drawing for explaining the state of the interior of the connector when the connection or the removal operation of the flat current is carried out of the connector for flat cables according to the present invention.
Figure 3B:
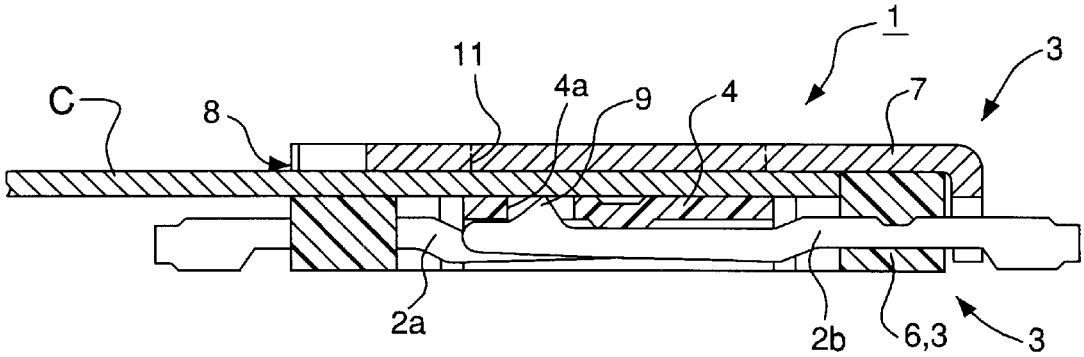

The connector 1 formed as described above can be used to connect a flat cable C by installing it on a printed board (not illustrated), and when connecting the flat cable C, by inserting the distal end of a tool such as a screw driver in the long hole 11 of the upper frame 7 and pressing down on the overhang 10 of the plate 4, as shown in FIG. 3 (a), the plate 4 is displaced downward due to the elasticity of each terminal 2*a* and 2*b* of the first and second groups, and thus a gap is formed between the upper plate 7 and the plate 4 into which the flat cable C can be inserted. Thus, while maintaining this state, when the end of the flat cable C is inserted into the insertion hole 8, the end of the flat cable C is not hindered by the terminals 2*a* and 2*b* of group 1 and group 2, and reaches a specified position within the housing 3 by advancing between the plate 4 and the upper frame 7.

Subsequently, when the flexible deformation of the terminals 2*a* and 2*b* of the first and second groups is relieved by extracting the tool from the long hole 11, as shown in FIG. 3 (a), the distal ends of each terminal 2*a* and 2*b* abut the distal ends of the flat cable C via the small holes 4*a,* and a current can be established.

When removing the flat cable C from the connector 1, each of the terminals 2*a* and 2*b* of the first and second group is deformed by displacing the plate 4 in the same manner, and when the flat cable C is pulled out after the distal ends of each terminal 2*a* and 2*b* are separated from the end of the flat cable C, the end of the flat cable C is extracted from the insertion hole 8 without interference from the terminals 2*a* and 2*b* of the first and second groups.

As explained above, according to the above-described connector 1, by arranging each terminal 2*a* of the first group and each terminal 2*b* of the second group so as to face each other, and at the same time dispose so as to alternate with each other the distal ends of each terminal 2*a* and 2*b* that serves as a contact point with the flat cable C, a flat cable C having even more metal wires than conventionally can be connected because even if the gap between each terminal 2*a* and 2*b* is narrow, the connection to the printed board does not become complicated. In addition, by carrying out the above operation, the flat cable C can be easily connected to and removed from the printed board.

In the present embodiment, an overhang 10 of a plate 4 and a long hole 11 of an upper frame 7 were provided as a plate displacing mechanism 5, and to operate this mechanism, a tapering tool such as a screw driver that can be inserted into the hole 11 is necessary. Thus, for example, if a button is exposed via the long hole 11 that can be pushed down by a finger is provided, the plate 4 can be displaced without a tool.

The following effects are attained by the connector for flat cables according to the present invention.

By arranging each terminal 2*a* of the first group and each terminal 2*b* of the second group so as to face each other, and at the same time dispose so as to alternate with each other the distal ends of each terminal 2*a* and 2*b* that serves as a contact point with the flat cable C, a flat cable C having even more metal wires than conventionally can be connected because even if the gap between each terminal 2*a* and 2*b* is narrow, the connection to the printed board does not become complicated.

By carrying out the operation of displacing the plate 4 due to the elasticity of each terminal of the first and second groups, the flat cable C can be easily connected to and removed from the printed board In the plate displacement mechanism, by using a structure comprising an overhang of the plate that overhangs in the outward traverse direction of the flat cable farther than the flat cable inserted into the housing, and an opening interfacing the overhang part formed in the direction of the displacement of the plate in the housing, the plate can be easily manipulated without being influenced by the flat cable.

What is claimed is:

1. An electrical connector for a substantially flat cable, comprising an insulative housing having an insertion opening formed therein, the insertion opening being adapted to receive an end portion of the substantially flat cable;

a first plurality of terminals each having a distal end serving as a connection point with the end portion of the substantially flat cable and being mounted in the housing and oriented in a first direction, and a second plurality of terminals each having a distal end serving as a connection point with the end portion of the substantially flat cable and being mounted in the housing and oriented in a second direction substantially opposite the first direction, wherein the first plurality of terminals are each mounted adjacent at least one of the second plurality of terminals so that the connection points of the first and second pluralities of terminals alternate between a respective first and second position in relation to a lengthwise direction of the first and second pluralities of terminals;

a plate being interposed in the space between the end portion of said substantially flat cable and each of the first and second pluralities of terminals; and a mechanism extending from said plate and comprising an overhang of said plate that overhangs in the outward transverse direction farther than the end portion of said substantially flat cable inserted into sad insertion opening, the mechanism being adapted to displace said plate so that said first and second pluralities of terminals elastically deform and thereby separate from the end portion of the said substantially flat cable, wherein a top portion of the housing has an opening formed therein and substantially aligned with the overhang of said plate.

2. The connector of claim 1, wherein the distal ends of the first and second pluralities of terminals each have a tooth portion that serves as the connection point with the end portion of the substantially flat cable.

3. The connector of claim 1, wherein the first and second pluralities of terminals are each angled upwardly in the lengthwise direction so that the first and second pluralities of terminals form an x-shaped pattern when viewed from a direction substantially transverse to the lengthwise direction.

4. A electrical connector for a substantially flat cable, comprising an insulative housing adapted to receive a end portion of the cable through an insertion opening formed therein;

a plurality of elongated terminals mounted at least partially in the housing and extending substantially in a lengthwise direction, wherein the terminals each have a first end adapted to contact the cable and thereby establish electrical contact with the cable, adjacent ones of the terminals are oriented in substantially opposite directions, and the first ends of adjacent ones of the terminals alternate between a first and a second position with respect to the lengthwise direction; and a plate positioned within the housing substantially between the cable and the terminals, the plate being adapted to move toward the terminals in response to a force exerted on the plate and thereby elastically deform the terminals so that the terminals are driven out of contact with the cable, wherein a top portion of the housing has an opening formed therein and substantially aligned with a transverse overhang of the plate that extends further than the end portion of the substantially flat cable to applying force to the plate.

5. The connector of claim 4, wherein the plate has a plurality of through holes formed therein, each of the through holes being substantially aligned with a respective one of the first ends of the terminals and thereby permitting contact between the first ends of the terminals and the cable.

* * * * *